US007634862B2

(12) United States Patent
Cockman

(10) Patent No.: US 7,634,862 B2
(45) Date of Patent: Dec. 22, 2009

(54) DOCK DONNING ASSIST DEVICE

(76) Inventor: Norman F Cockman, 122 Melbourne La., Greenville, SC (US) 29615

( * ) Notice: Subject to any disclaimer, the term of this patent is extended or adjusted under 35 U.S.C. 154(b) by 567 days.

(21) Appl. No.: 11/599,528

(22) Filed: Nov. 14, 2006

(65) Prior Publication Data

US 2008/0110945 A1 May 15, 2008

(51) Int. Cl.
*A43B 11/00* (2006.01)
*A47G 25/80* (2006.01)

(52) U.S. Cl. ..... 36/138; 223/113

(58) Field of Classification Search ..... 36/1, 36/7.1 R, 138; 223/113
See application file for complete search history.

(56) References Cited

U.S. PATENT DOCUMENTS 312,321 A * 2/1885 Blohm ..... 223/113
459,680 A * 9/1891 Donauer ..... 223/113
2,982,453 A 5/1961 Zicarelli
3,231,160 A 1/1966 Glanville
3,775,793 A * 12/1973 Casavant et al. ..... 12/1 R
4,066,194 A 1/1978 Leland
4,260,083 A 4/1981 Aslin
4,284,216 A 8/1981 Leland
4,516,704 A 5/1985 Hagman
4,638,932 A 1/1987 Keller
4,667,861 A * 5/1987 Harrington et al. ..... 223/113
4,683,876 A * 8/1987 Changras ..... 128/897
4,765,520 A 8/1988 Barton
4,789,087 A 12/1988 Doorenbos
4,896,803 A 1/1990 Wilkens
4,942,988 A 7/1990 Doorenbos
5,082,154 A 1/1992 French
D337,881 S 8/1993 Peeler
5,249,720 A 10/1993 White
5,303,856 A 4/1994 Weatherholt, Sr.
5,322,199 A 6/1994 White
5,630,534 A 5/1997 Maier et al.
5,632,424 A 5/1997 Maier et al.
6,532,686 B2 * 3/2003 Gultekin et al. ..... 36/7.1 R
6,543,075 B2 * 4/2003 Gultekin et al. ..... 12/1 R

* cited by examiner

*Primary Examiner*—Marie Patterson
(74) *Attorney, Agent, or Firm*—J. Bennett Mullinax, LLC

(57) ABSTRACT

An apparatus for aiding in the donning of a foot covering is provided. One embodiment of the apparatus includes a base supported by the floor with a surface oriented at an angle to the floor so that it is not parallel to the floor. The surface has an area sufficient for contact with at least a portion of the bottom of a foot of a user. A foot covering retaining member is provided and is carried by the base. The foot covering retaining member is configured for receiving a foot covering and holding open an opening of the foot covering.

20 Claims, 4 Drawing Sheets

DOCK DONNING ASSIST DEVICE

FIELD OF THE INVENTION

The present invention relates generally to a sock donning assist device for use in helping an individual insert his or her foot into a sock in order to aid in wearing of the sock. More particularly, the present application involves a sock donning assist device that allows socks to be placed on both of the feet of the user in an ergonomic manner.

BACKGROUND

Individuals sometimes have limited body movement through injury, pregnancy, old age, disability or obesity. In these instances, a person may not have sufficient flexibility to bend his or her leg in order to put their foot into a sock for purposes of wearing the sock. Further, individuals that have circulatory disorders are sometimes challenged in putting on tight-fitting socks which are designed to reduce pooling of fluids in the person's feet and legs. In these instances, one may not be capable of applying the force necessary to don the sock. As such, devices are known to assist an individual in the donning of socks.

One such type of known device employs a metal frame around which a sock is retained so that the upper portion of the sock is opened thus exposing its interior. A healthcare provider grasps a handle of the device and positions the toes of the patient into the opening of the sock. The healthcare provider can then manipulate the device so that the sock is drawn around the heel of the patient and over his or her leg. Although this device achieves its goal of assisting in the donning of a sock, it requires a healthcare provider positioned opposite the individual be present to guide the sock onto and then over the foot.

Other types of devices are known to provide assistance to the individual without the need of a healthcare provider. One such device makes use of a metal frame with an elongated handle. The individual can open the sock and retain it onto a portion of the metal frame. Next, the individual grasps the handle and maneuvers the device so that his or her toes are positioned inside of the opening of the sock. The user can then pull the sock around his or her heel and ankle in order to slide the sock onto proper position on his or her foot. Although this type of device does not require the presence of a healthcare provider, it may be problematic in that it necessitates a great deal of manipulation of the handle of the device to properly slide the sock into the desired position. Individuals in need of a device to assist them in donning a sock often times do not possess adequate dexterity to comfortably manipulate such a device.

Aids for the donning of socks are known that rest on the floor. These types of aids hold open a sock and allow the individual to step into or otherwise push his or her foot forward into the open sock to envelop the foot within. Although these types of devices minimize the use of the individual's hands in the donning of socks, they are problematic in that the angle into which the individual must orient his or her foot requires a degree of acrobatic skill. Although certain devices hold the sock at a more desirable angle, they may be problematic in that they can tip over or be forced forward when the individual's foot is pushed into the sock. Further, these devices may lack certain ergonomic features that make donning of the sock an easier task. As such, there remains room for variation and improvement within the art.

SUMMARY

Various features and advantages of the invention will be set forth in part in the following description, or may be obvious from the description, or may be learned from practice of the invention.

One aspect of the present invention provides for an apparatus for aiding in the donning of a foot covering. The apparatus includes a base supported by the floor and with a surface oriented at an angle to the floor so that the surface is not parallel to the floor. The surface has an area sufficient for being contacted by at least a portion of the bottom of a foot of a user. A foot covering retaining member that is carried by the base is also present. The foot covering retaining member is configured for receiving a foot covering and holding open an opening of the foot covering.

Another aspect of the present invention is provided in an apparatus as immediately discussed in which the angle of the surface to the floor is from 10° to 45°.

An additional aspect of the present invention is found in an apparatus as mentioned above in which the base is adjustable in order to modify the angle of the surface to the floor.

Also provided in accordance with another aspect of the present invention is an apparatus as previously described in which the base defines a foot receiving opening that extends through the base. The foot receiving opening is not completely surrounded by the base. Also, the foot covering retaining member is located proximate to the foot receiving opening.

The present invention also provides in an additional aspect for an apparatus as described previously in which the foot covering retaining member is three posts that are cylindrical in shape. The posts extend from the surface of the base so that the axes of the posts are perpendicular to the surface of the base and are oriented at an angle to the floor.

Another aspect of the present invention exists in an apparatus described above that has a second foot covering retaining member carried by the base. The second foot covering retaining member is configured for receiving a foot covering and holding open an opening of the foot covering.

An additional aspect of the present invention is found in an apparatus as immediately mentioned in which the base defines a second foot receiving opening that extends through the base. The second foot receiving opening is not completely surrounded by the base. The second foot covering retaining member is located proximate to the second foot receiving opening.

Another aspect of the present invention resides in an apparatus as mentioned above in which the second foot covering retaining member is three posts that are cylindrical in shape. The posts extend from the surface of the base so that the axes of the posts are perpendicular to the surface of the base and are oriented at an angle to the floor.

A further aspect of the present invention exists in an apparatus as mentioned above that also has a foot receiving member. The foot receiving member has a surface sufficient for being contacted by substantially all of the bottom of a foot of the user. The foot receiving member extends from the surface of the base. The surface of the foot receiving member is parallel to the surface of the base.

Another aspect of the present invention provides for an apparatus for aiding in the donning of a foot covering. The apparatus includes a base supported by the floor. A foot covering retaining member is carried by the base. The foot covering retaining member is configured for receiving a foot covering and holding open an opening of the foot covering. A foot receiving member is also present and has a surface sufficient for being contacted by at least a portion of the bottom of a foot of the user. The foot receiving member is carried by the base. The surface of the foot receiving member is oriented at an angle to the floor so that the surface is not parallel to the floor.

Another aspect of the present invention resides in an apparatus as immediately mentioned in which the surface of the foot receiving member is planar. The surface of the foot receiving member is sized for contact with substantially all of the bottom of a foot of the user.

Another aspect of the present invention exists in an apparatus as mentioned above in which the angle of the surface of the foot receiving member to the floor is from 10° to 45°.

Yet another aspect of the present invention is provided for in an apparatus as previously discussed in which the base is adjustable so as to modify the angle of the surface of the foot receiving member to the floor.

Also provided in another aspect of the present invention is an apparatus as mentioned prior in which the base has a surface oriented at an angle to the floor so that the surface is not parallel to the floor. The surface of the base has an area sufficient for being contacted by at least a portion of the bottom of a foot of the user.

One aspect of the present invention provides for an apparatus for aiding in the donning of a foot covering. A base is included and is supported by the floor. The base has a surface oriented at an angle from 10° to 45° to the floor so that the surface is not parallel to the floor. The surface has an area sufficient for being contacted by at least a portion of the bottom of a foot of a user. A foot covering retaining member is carried by the base. The foot covering retaining member is configured for receiving a foot covering and holding open an opening of the foot covering. The foot covering retaining member is three posts that are cylindrical in shape and extend from the surface of the base so that the axes of the posts are perpendicular to the surface of the base and are oriented at an angle to the floor. The base defines a foot receiving opening that extends through the base. The foot receiving opening is not completely surrounded by the base. The foot covering retaining member is located proximate to the foot receiving opening. A second foot covering retaining member is carried by the base. The second foot covering retaining member is configured for receiving a foot covering and holding open an opening of the foot covering. The second foot covering retaining member is three posts that are cylindrical in shape and extend from the surface of the base. The axes of the posts are perpendicular to the surface of the base and are oriented at an angle to the floor. The base defines a second foot receiving opening that extends through the base. The second foot receiving opening is not completely surrounded by the base. The second foot covering retaining member is located proximate to the second foot receiving opening. A foot receiving member is present and has a surface sufficient for being contacted by substantially all of the bottom of a foot of the user. The foot receiving member is carried by the base. The surface of the foot receiving member is oriented at an angle to the floor so that the surface is not parallel to the floor. The surface of the foot receiving member is parallel to the surface of the base. The foot receiving member extends from a location on the surface of the base located between the foot covering retaining member and the second foot covering retaining member.

These and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended Figs. in which.

Figure 1:
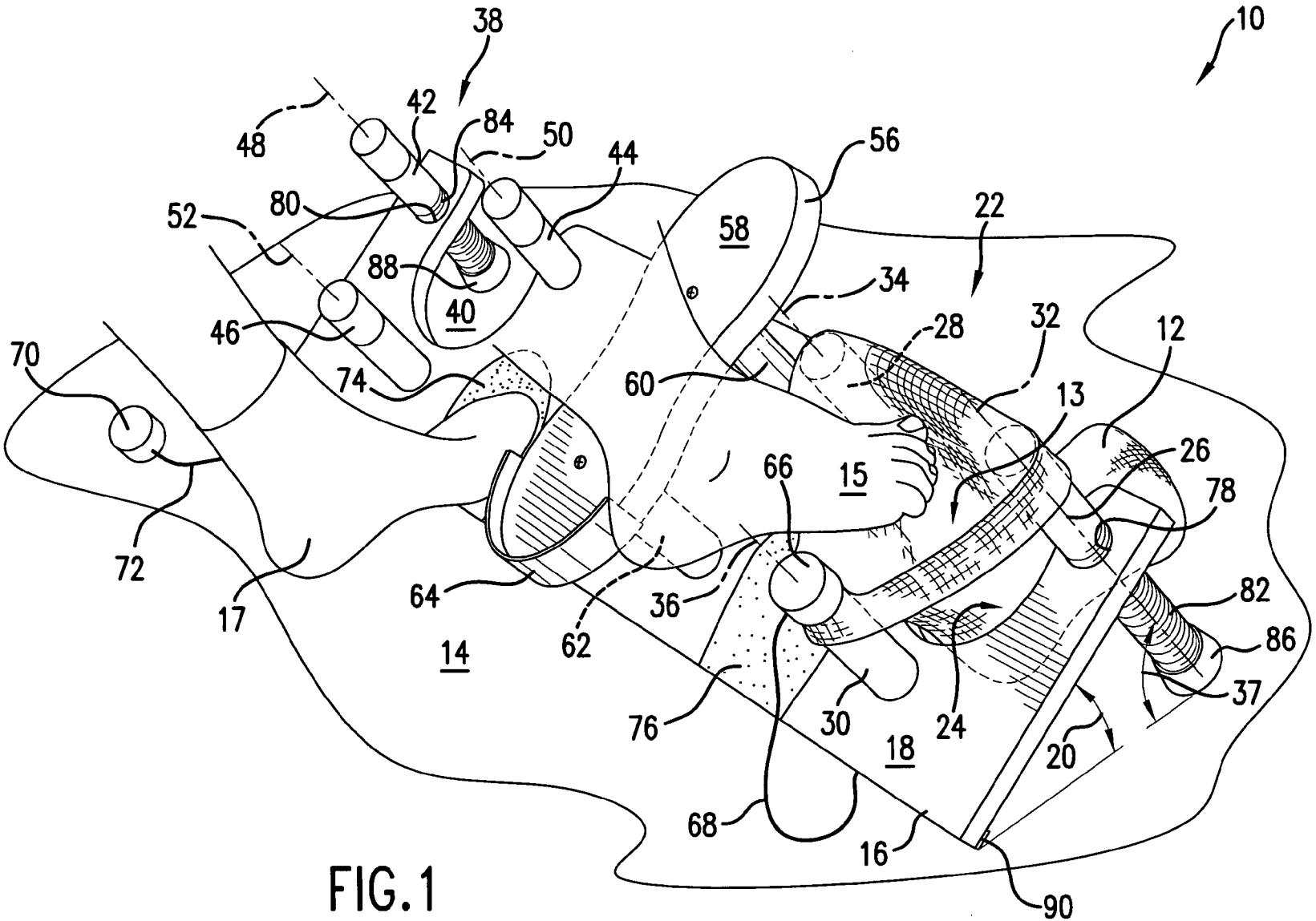
FIG. 1 is a perspective view of an apparatus for aiding in the donning of a foot covering in accordance with one exemplary embodiment of the present invention.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present application provides for an apparatus 10 to aid in the donning of a foot covering 12 such as a sock. The apparatus 10 rests on the floor 14 and retains and holds open the foot covering 12 to allow a user to insert his or her foot 15 therein. The apparatus 12 is configured to hold the foot covering 12 at an angle so that the user can more easily insert his or her foot 15 into the foot covering 12 and pull the foot covering 12 into proper position. The apparatus 12 may include an area onto which the user may position his or her other foot 17 to obtain leverage while donning the foot covering 12 onto the other foot 15.

One exemplary embodiment of the apparatus 10 is shown in FIG. 1. Here, the apparatus 10 is shown resting on the floor 14 so that a surface 18 of a base 16 of the apparatus 10 is oriented at an angle 20 to the floor 14. A foot covering retaining member 22 is located on the base 16. The foot covering retaining member 22 is located proximate to and here essentially surrounds a foot receiving opening 24. The foot receiving opening 24 is an opening that extends completely through the base 16 and is positioned proximate to an upper edge of the base 16 so that the foot receiving opening 24 is not completely surrounded by the base 16. However, it is to be understood that in accordance with other exemplary embodiments of the present invention that the foot receiving opening 24 may extend completely through the base 16 and may likewise be completely surrounded by the base 16. In these embodiments, the foot receiving opening 24 can be a hole, slot or other variously shaped aperture. Also, it is to be understood that even further exemplary embodiments of the present invention exist in which the foot receiving opening 24 is not present.

The foot covering retaining member 22 is made of three posts 26, 28 and 30 in the exemplary embodiment shown in FIG. 1. The three posts 26, 28 and 30 are located around the foot receiving opening 24 so that posts 26 and 28 are on opposite sides of the foot receiving opening 24 while post 30 is located next to the bottom of the foot receiving opening 24 and somewhat in between posts 26 and 28. Posts 26, 28 and 30 are cylindrically shaped members in the exemplary embodiment shown. However, it is to be understood that other embodiments exist in which the posts 26, 28 and 30 can be of any shape such as flat bars, sinusoidal, helix or square shaped. Applicant theorizes that the cylindrically shaped posts 26, 28 and 30 act to give a more desired hold and opening of the foot covering 12 due to their circular cross-section. However, the present invention contemplates other configurations in which the posts 26, 28 and 30 are variously shaped. As shown in FIG. 1, the axes 32, 34 and 36 of posts 26, 28 and 30 are perpendicular to the surface 18 of base 16. Although three posts 26, 28 and 30 are shown, other embodiments exist in which up to 10 posts may be present in foot covering retaining member 22. Further, other embodiments exist in which no posts may be provided in foot covering retaining member 22. In these embodiments, for instance, the foot covering retaining member 22 may include a horseshoe shaped sleeve that can receive and retain the foot covering 12.

A foot covering 12 is retained by the foot covering retaining member 22. Although shown as a sock in FIG. 1, the foot covering 12 can be other items capable of being donned onto the foot 15 of the user. For example, the foot covering 12 can be stockings, hosiery, leggings or pants, to name but a few, in accordance with other exemplary embodiments. The top portion of the foot covering 12 is opened and pulled over the three posts 26, 28 and 30 of the foot covering retaining member 22. Doing so retains the foot covering 12 onto the foot covering retaining member 22 and also exposes an opening 13 of the foot covering 12. Various components of the apparatus 10 act to angle the opening 13 to the floor 14. The user may then position his or her foot 15 into the opening 13 and push downward at an angle thereon. This act tends to pull the foot covering 12 over the foot 15 and around the ankle of the user. Further pushing of the foot 15 causes the foot covering 12 to be pulled from the foot covering retaining member 22 and hence off of the apparatus 10. The user can then pull any remaining portion of the foot covering 12 up his or her leg if necessary. Both the foot 15 and the foot covering 12 can be inserted into and through the foot receiving opening 24. Also during the donning process, the foot 15 and foot covering 12 can be moved out of the open end of the foot receiving opening and hence upwards and away from the edge of the base 16 and away from the floor 14. The configuration of apparatus 10 thus allows the foot covering 12 to be donned while the user is sitting in a chair or on the edge of the bed. The user may but need not be standing while donning the foot covering 12.

A cap 66 can also be provided in accordance with certain exemplary embodiments. Cap 66 is tethered to the base 16 by way of a string 68 attached to the lower edge of base 16. Cap 66 is sized so as to fit over the top of post 30. In use, the cap 66 is placed over the portion of the foot covering 12 that is positioned onto the top of post 30. Here, cap 66 acts to help hold the foot covering 12 onto the top of post 30 and hence acts to help retain the foot covering 12 onto the foot covering retaining member 22. Once the user positions his or her foot 15 into opening 13 and pushes forward in order to don the foot covering 12, the foot covering 12 will be pulled upwards off of the posts 26, 28 and 30 and hence cap 66 will be forced off of post 30 and will no longer act to retain the foot covering 12 thereon. As such, cap 66 will be removed by the act of donning the foot covering 12 and need not be removed by the hand of the user. However, other embodiments exist in which cap 66 may in fact be removed by the hand of the user after insertion of his or her foot 15 into foot covering 12. Also, further embodiments exist in which cap 66 may be able to be located on any of posts 26, 28 or 30. Additionally, each of the posts 26, 28 and 30 may be fitted with a cap in accordance with yet another embodiment, or the presence of caps may be completely eliminated in yet other variations of the present invention.

The feet 15 and 17 may be either bare feet of the user or may be feet that are covered with some object. For example, the feet 15 and 17 may be feet that have tight fitting hosiery, slippers, shoes, socks or bandages thereon. As such, it is to be understood that the term "foot" as used herein means more than just the bare foot of the user.

The apparatus 10 also includes a second foot covering retaining member 38 as shown in FIG. 1. A second foot receiving opening 40 is defined by the base 16 and is surrounded on essentially three sides thereby. The upper end of the second foot receiving opening 40 is opened so that this component is not completely surrounded by the base 16. The second foot receiving opening 40 extends completely through the base 16. Although shown as being configured in a manner similar to the foot receiving opening 24, the second foot receiving opening 40 may be provided differently in accordance with other exemplary embodiments. In still further embodiments, the second foot receiving opening 40 need not be present. The second foot covering retaining member 38 includes three posts 42, 44 and 46 that are cylindrical and extend from the surface 18 of the base 16. Posts 42, 44 and 46 have axes 48, 50 and 52 that are oriented perpendicular to surface 18. The second foot covering retaining member 38 may be constructed in any manner as previously described with respect to the foot covering retaining member 22. However, in the exemplary embodiment shown, the second foot covering retaining member 38 is configured in an identical manner to the foot covering retaining member 22. As such, a user may retain a foot covering 12 onto the second foot covering retaining member 22 in a similar manner as described above and may don the foot covering 12 in a like manner. The functionality of the second foot receiving opening 40 is the same as described above with respect to foot receiving opening 24 when donning the foot covering 12.

A cap 70 is tethered to base 16 by a string 72. Cap 70 may be positioned over the top of post 46. Cap 70 can be used to help retain the foot covering 12 onto the second foot covering retaining member 38 in a manner similar to that of cap 66 as described above. Further, the previously mentioned embodiments also apply to cap 66 in which the cap 66 can be retained onto the tops of various posts 42, 44 or 46. Also as mentioned, multiple caps may be used or no caps may be present in association with the second foot covering retaining member 38 in accordance with other alternative embodiments.

The presence of the second foot covering retaining member 38 and second foot receiving opening 40 allows a second foot covering 12 to be donned. In this manner, one may first place a pair of foot coverings 12 onto the foot covering retaining members 22 and 38. Placement of foot covering 12 can be done either while the apparatus 10 rests on the floor 14 or may be done while holding the apparatus 10 on a table, bed or in the lap of the user. The apparatus 10 and retained foot coverings 12 can then be placed on the floor 14 and the foot coverings 12 may be donned one after the other in the previously described manner. The presence of two foot covering retaining members 22 and 38 acts to speed up the donning process as foot coverings 12 can be retained at a single time without having to put one foot covering 12 on and then pick up the apparatus 10, retain a second foot covering 12 and then place the apparatus 10 back onto the floor 14 into position. However, it is to be understood that other exemplary embodiments of the present invention exist in which but a single foot covering retaining member 22 is present.

Figure 2:
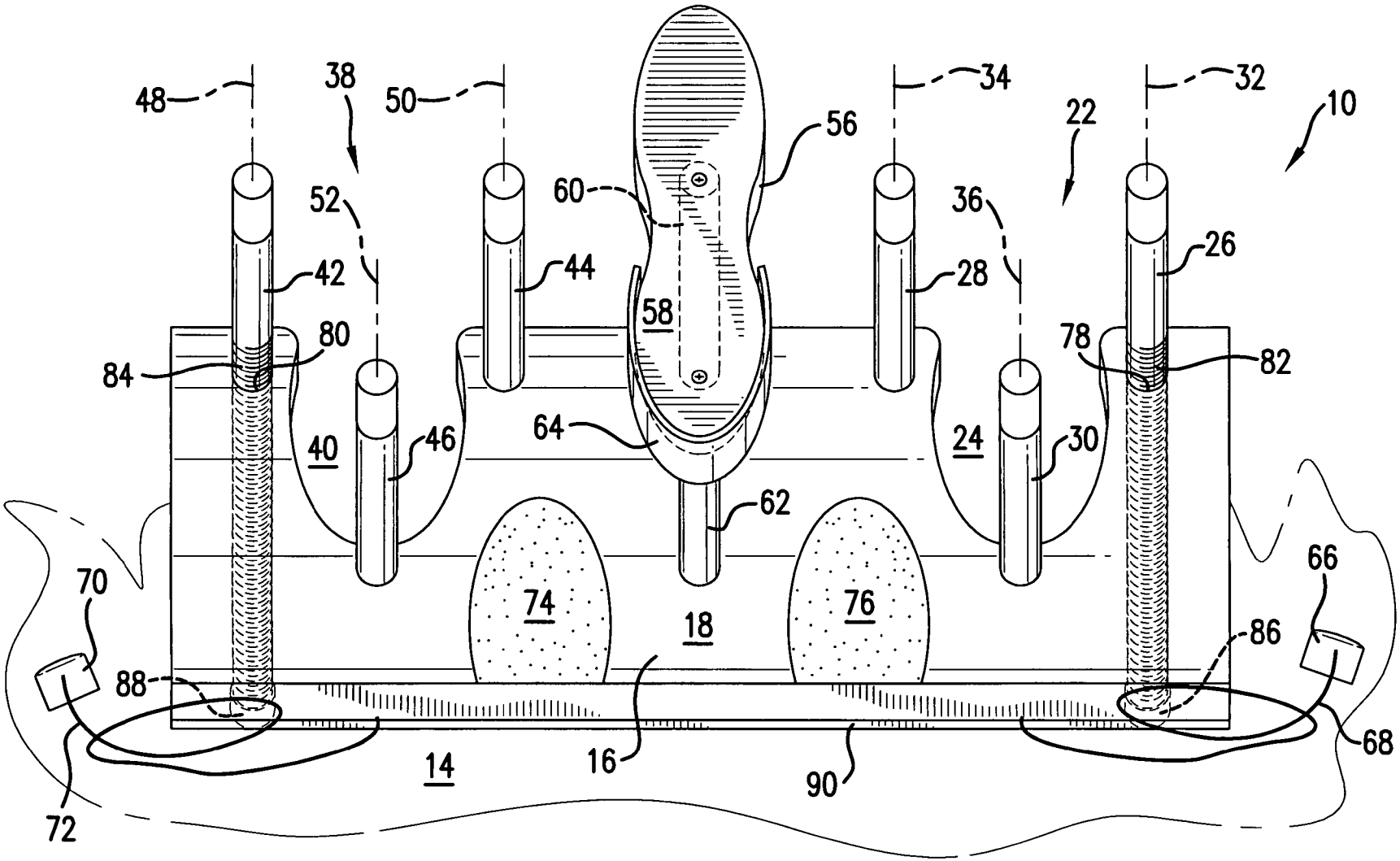
FIG. 2 is a front view of the apparatus of FIG. 1.

As shown in FIG. 1 and as may be more clearly seen with reference to FIG. 2, the surface 18 of base 16 has an area sufficient for being contacted by at least a portion of the other foot 17 of the user that is not having the foot covering 12 donned thereon. The area of surface 18, along with other portions of surface 18 may be smooth, rough, convex, concave or may be provided with apertures, frictional elements or other features. A portion of the foot 17 can be applied against an area of surface 18 to provide leverage when donning the foot covering 12 onto foot 15. The angular orientation of base 16 allows the user to push against surface 18 with foot 17 without having to worry about pushing the apparatus 10 forward on the floor 14 and hence cause the retained foot covering 12 to be moved out of reach. The area of surface 18 exposed for contact with foot 17 may be sized so as to allow only the toes or heel of foot 17 to be received thereon. As shown in FIG. 1, a pair of foot gripping areas 74 and 76 are present on the surface 18. The foot gripping areas 74 and 76 include grit like frictional members that provide traction when contacted by foot 17. The foot gripping areas 74 and 76 can each receive roughly half of the foot 17 of the user and are shaped roughly in the shape of the upper half of the bottom of foot 17. The user can place the upper half of the bottom of foot 17 onto the foot gripping area 74 and press there against when positioning the other foot 15 into foot covering 12 on the foot covering retaining member 22. When donning the foot covering 12 on the second foot covering retaining member 38, one may place his or her other foot 17 onto the other foot gripping area 76 for additional leverage during the donning process. Placement and urging of foot 17 onto the foot gripping areas 74 and 76 may also act to steady the apparatus 10 and keep the foot covering 12 still during the donning process.

Although shown as having foot gripping areas 74 and 76, the surface 18 need not be provided with these areas 74 and 76 in other embodiments. Here, the surface 18 need only have a portion large enough to receive a portion of the foot 17 to allow the user to push onto the apparatus 10 when donning foot covering 12. The area available to the user may be as large as or may be smaller than the foot gripping areas 74 and 76 shown and may have a surface composition the same as or different from the rest of the surface 18. In accordance with one exemplary embodiment, the area, which may be the foot gripping areas 74 and 76, are provided in order to allow a planar portion of the foot 17 of the user to contact the apparatus 10 and a planar portion of the foot 17 to contact the floor 14. Other embodiments are possible in which the area available allows for all of the bottom of the foot 17 to be contacted. Other exemplary embodiments are present in which the surface 18 does not have an area sufficient for being contacted by at least a portion of the foot 17 of the user.

The apparatus 10 has a foot receiving member 56. The foot receiving member 56 is elevated from the surface 18 through the use of a pair of supports 60 and 62. The foot receiving member 56 has a surface 58 which is roughly in the shape of the bottom of the foot 17 as shown in FIG. 2. However, it is to be understood that other exemplary embodiments of the present invention exist in which the surface 58 is variously shaped. The surface 58 is oriented so as to be parallel to the surface 18 of base 16. In other arrangements, surface 58 is oriented at an angle to surface 18. A user may place his or her foot 17 onto surface 58 when donning the foot covering 12 onto foot 15. A guard 64 may be present along the bottom edge portion of surface 58 in order to help retain the heel of the foot 17 thereon. The user can place his or her foot 17 onto surface 58 and press downwards when donning the foot covering 12 onto foot 15 in order to help steady the apparatus 10 and gain leverage during the donning process. As surface 58 is angled with respect to the floor 14, downward pressing of the foot 17 will not cause the apparatus 10 to be slid forward along the floor 14 but instead the angular component of the force will tend to pinch the apparatus 10 between the floor 14 and foot 17. The surface 58 can be flat or contoured and may have apertures, frictional elements or grooves provided thereon in accordance with various embodiments. Although shown as receiving substantially all of the bottom of the foot 17, the surface 58 can be provided so that less than all of the bottom of foot 17 may be contacted. It is likewise to be understood that other exemplary embodiments are present in which the foot receiving member 56 is not present.

Figure 3:
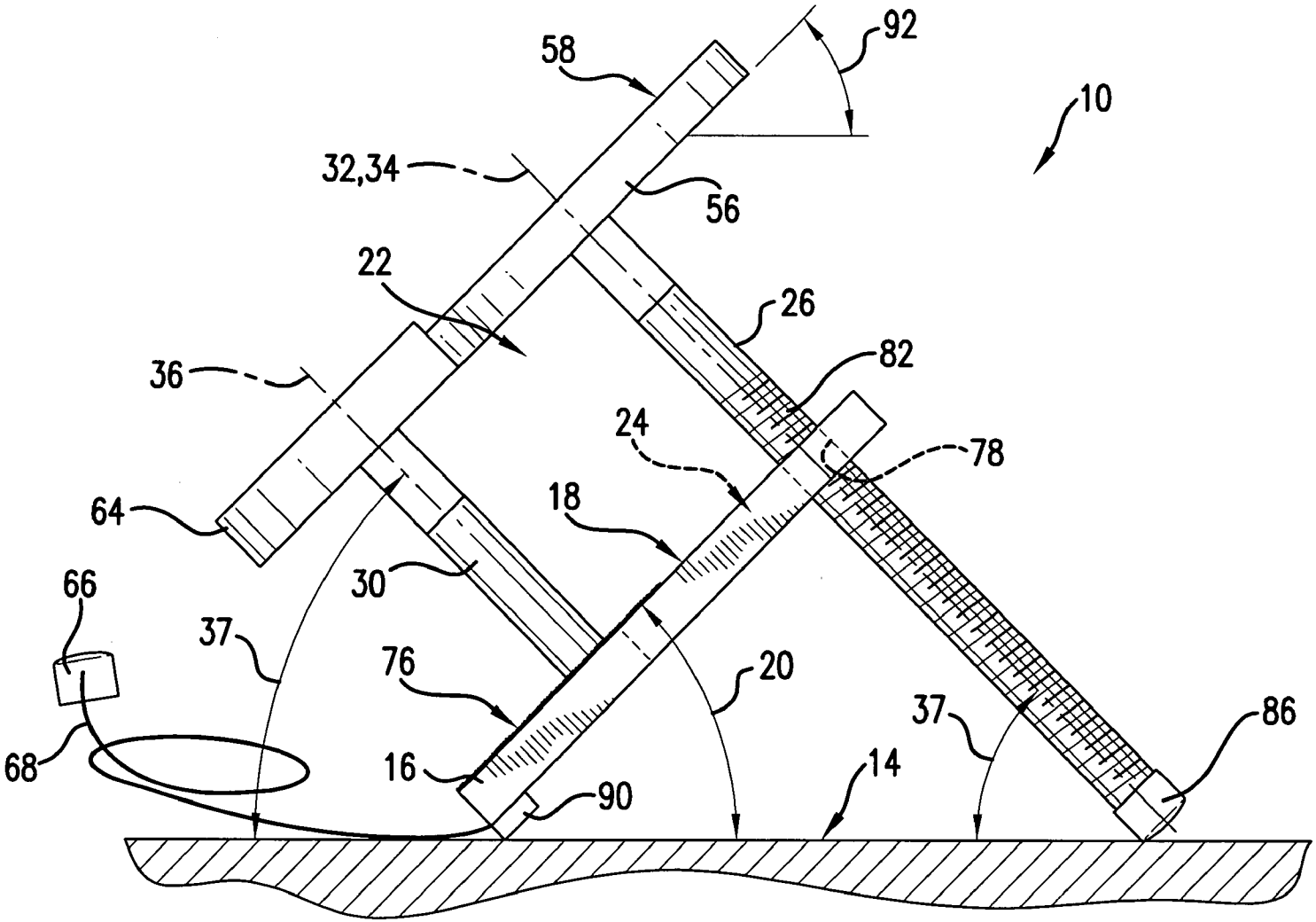
FIG. 3 is a side view of the apparatus of FIG. 1.

FIG. 3 shows a side view of the apparatus 10 of FIG. 1 as it rests on the floor 14. The surface 18 of base 16 is oriented at an angle 20 to floor 14. In accordance with various exemplary embodiments of the present invention, angle 20 may be from 10° to 45°. Angle 20 may be fixed or may be adjustable as will be discussed below. Also shown in FIG. 3 is the angular orientation of the axes 32, 34 and 36 to floor 14. Here, the axes 32, 34 and 36 are oriented at an angle 37 to floor 14. Angle 37 may be from 45° to 80° in accordance with various exemplary embodiments. Angle 37 is adjustable if the angular orientation of base 16 with respect to the floor is likewise adjustable.

Posts 28 and 30 of the foot covering retaining member 22 do not extend through base 16. However, post 26 is shown as having a length sufficient to extend through base 16 as can be seen in FIG. 3. A portion of the outer length of post 26 is provided with external threading 82 which engages an internally threaded aperture 78 defined in base 16 and through which post 26 extends. The user can rotate post 26 in order to adjust the length of post 26 located below base 16. A longer portion of post 26 located below base 16 causes a steeper angle 20 to be realized when the apparatus 10 is placed onto floor 14. The bottom of post 26 has a rubber end cap 86 disposed thereon in order to prevent damage to the floor 14. A resilient strip 90 is present at the lower edge on the underside of base 16 and likewise contacts the floor 14 to prevent damage thereto. The resilient strip 90 runs the length of the base 16.

Figure 4:
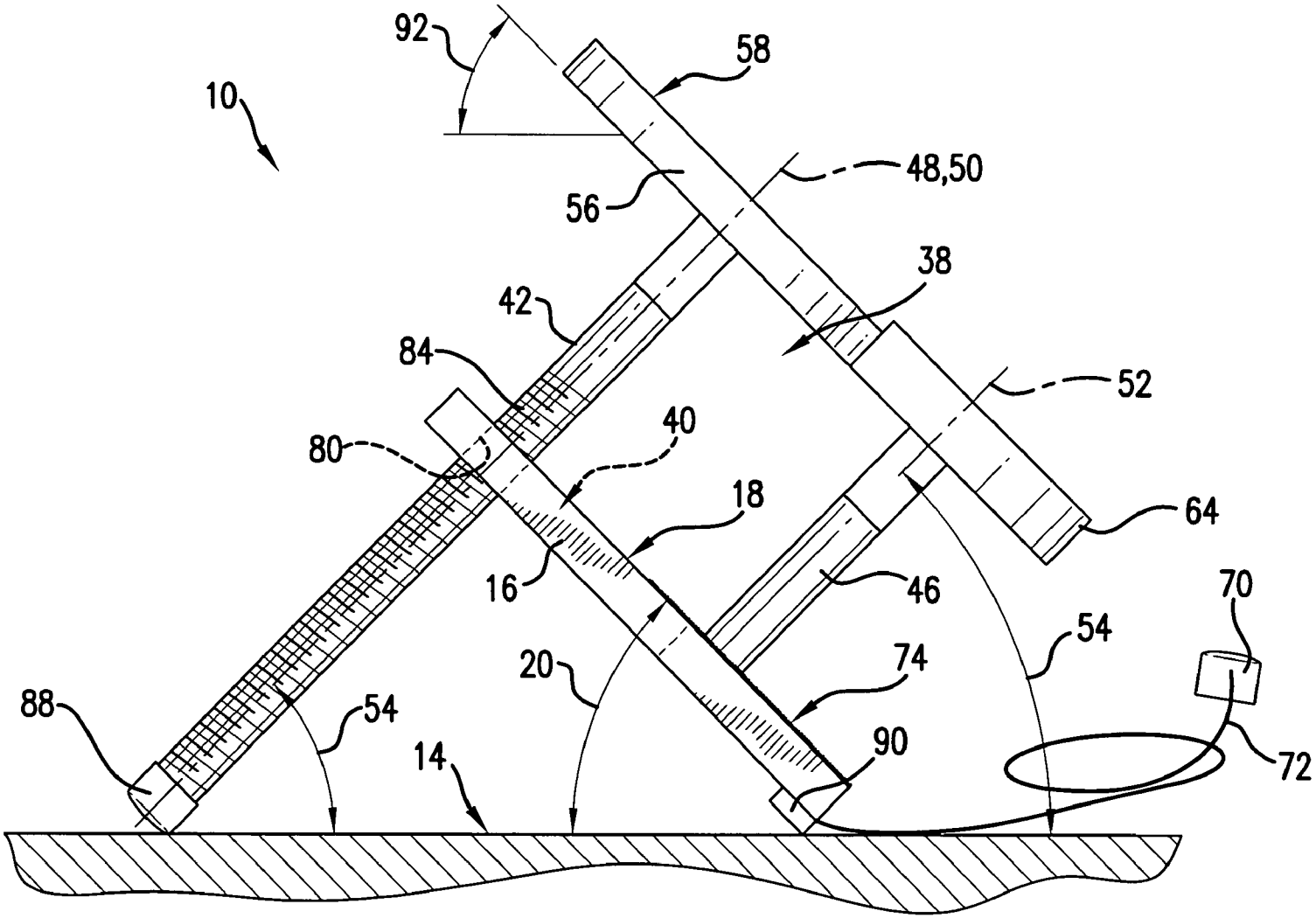
FIG. 4 is a side view of the apparatus of FIG. 1 taken from a side opposite that shown in FIG. 3.

Referring now to FIG. 4, the side of apparatus 10 opposite that which is shown in FIG. 3 can be seen. Here, the second foot covering retaining member 38 has axes 48, 50 and 52 that are oriented at an angle 54 to floor 14. Angle 54 can be from 45° to 80° in accordance with various exemplary embodiments. Modification of angle 20 will likewise cause an adjustment of the degree of angle 54. As can be seen, post 42 extends through an internally threaded aperture 80 of the base 16. External threading 84 on post 42 engages the internally threaded aperture 80 and allows the positioning of post 42 with respect to base 16 to be adjusted. Adjustment of both posts 26 and 42 can be made in order to fix the angle 20 of surface 18 to floor 14. Post 42 likewise has an end cap 88 on one end in order to protect floor 14. The surface 58 of foot member 56 is oriented at an angle 92 to the floor 14. Angle 92 can be from 10° to 45° in various embodiments. Although shown as the same as angle 20, angle 92 can be different from angle 20 in other configurations. Also, although described as being adjustable, it is to be understood that the apparatus 10 may be nonadjustable so that the orientation of surface 18 and other components remain fixed with respect to the floor 14.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. An apparatus for aiding in the donning of a foot covering, comprising:

a base supported by the floor and having a surface oriented at an angle to the floor such that said surface is not parallel to the floor, wherein said surface has an area sufficient for being contacted by at least a portion of the bottom of a foot of a user; and a foot covering retaining member carried by said base, said foot covering retaining member configured for receiving a foot covering and holding open an opening of the foot covering.

2. The apparatus as set forth in claim 1, wherein said angle of said surface to the floor is from 10° to 45°.

3. The apparatus as set forth in claim 1, wherein said base is adjustable so as to modify said angle of said surface to the floor.

4. The apparatus as set forth in claim 1, wherein said base defines a foot receiving opening that extends through said base, and wherein said foot receiving opening is not completely surrounded by said base, and wherein said foot covering retaining member is located proximate to said foot receiving opening.

5. The apparatus as set forth in claim 1, wherein said foot covering retaining member is three posts that are cylindrical in shape and extend from said surface of said base such that the axes of said posts are perpendicular to said surface of said base and are oriented at an angle to the floor.

6. The apparatus as set forth in claim 5, further comprising a cap tethered to said base, wherein said cap is capable of being received onto the top of one of said posts, and wherein when said three posts receive the foot covering said cap is received onto the top of one of said posts in order to help hold the foot covering onto the top of said post.

7. The apparatus as set forth in claim 1, further comprising a second foot covering retaining member carried by said base, said second foot covering retaining member configured for receiving a foot covering and holding open an opening of the foot covering.

8. The apparatus as set forth in claim 7, wherein said base defines a second foot receiving opening that extends through said base, and wherein said second foot receiving opening is not completely surrounded by said base, and wherein said second foot covering retaining member is located proximate to said second foot receiving opening.

9. The apparatus as set forth in claim 7, wherein said second foot covering retaining member is three posts that are cylindrical in shape and extend from said surface of said base such that the axes of said posts are perpendicular to said surface of said base and are oriented at an angle to the floor.

10. The apparatus as set forth in claim 1, further comprising a foot receiving member having a surface sufficient for being contacted by substantially all of the bottom of a foot of the user, wherein said foot receiving member extends from said surface of said base, and wherein said surface of said foot receiving member is parallel to said surface of said base.

11. The apparatus as set forth in claim 10, wherein said surface of said foot receiving member is planar.

12. An apparatus for aiding in the donning of a foot covering, comprising:

a base supported by the floor;

a foot covering retaining member carried by said base, said foot covering retaining member configured for receiving a foot covering and holding open an opening of the foot covering; and a foot receiving member having a surface sufficient for being contacted by at least a portion of the bottom of a foot of the user, wherein said foot receiving member is carried by said base, and wherein said surface of said foot receiving member is oriented at an angle to the floor such that said surface is not parallel to the floor.

13. The apparatus as set forth in claim 12, wherein said base has a surface, and wherein said foot receiving member and said foot covering retaining member extend from said surface of said base, and wherein said surface of said foot receiving member is parallel to said surface of said base.

14. The apparatus as set forth in claim 12, wherein said surface of said foot receiving member is planar, and wherein said surface of said foot receiving member is sized so as to be capable of being contacted by substantially all of the bottom of a foot of the user.

15. The apparatus as set forth in claim 12, wherein said angle of said surface of said foot receiving member to the floor is from 10° to 45°.

16. The apparatus as set forth in claim 12, wherein said base is adjustable so as to modify said angle of said surface of said foot receiving member to the floor.

17. The apparatus as set forth in claim 12, wherein said base has a surface oriented at an angle to the floor such that said surface is not parallel to the floor, wherein said surface of said base has an area sufficient for being contacted by at least a portion of the bottom of a foot of the user.

18. The apparatus as set forth in claim 12, further comprising a second foot covering retaining member carried by said base, said second foot covering retaining member configured for receiving a foot covering and holding open an opening of the foot covering;

wherein said base defines a foot receiving opening that extends through said base, and wherein said foot receiving opening is not completely surrounded by said base, and wherein said foot covering retaining member is located proximate to said foot receiving opening;

wherein said base defines a second foot receiving opening that extends through said base, and wherein said second foot receiving opening is not completely surrounded by said base, and wherein said second foot covering retaining member is located proximate to said second foot receiving opening.

19. The apparatus as set forth in claim 18, wherein said foot covering retaining member is three posts that are cylindrical in shape and extend from said base such that the axes of said posts are perpendicular to said surface of said foot receiving member and are oriented at an angle to the floor;

wherein said second foot covering retaining member is three posts that are cylindrical in shape and extend from said base such that the axes of said posts are perpendicular to said surface of said foot receiving member and are oriented at an angle to the floor;

further comprising a cap tethered to said base, wherein said cap is capable of being received onto the top of one of said posts of said foot covering retaining member, and wherein when said three posts of said foot covering retaining member receive the foot covering said cap is received onto the top of one of said posts of said foot covering retaining member in order to help hold the foot covering onto the top of said post of said foot covering retaining member; and further comprising a second cap tethered to said base, wherein said second cap is capable of being received onto the top of one of said posts of said second foot covering retaining member, and wherein when said three posts of said second foot covering retaining member receive the foot covering said second cap is received onto the top of one of said posts of said second foot covering retaining member in order to help hold the foot covering onto the top of said post of said second foot covering retaining member.

20. An apparatus for aiding in the donning of a foot covering, comprising:

a base supported by the floor and having a surface oriented at an angle from 10° to 45° to the floor such that said surface is not parallel to the floor, wherein said surface has an area sufficient for being contacted by at least a portion of the bottom of a foot of a user;

a foot covering retaining member carried by said base, said foot covering retaining member configured for receiving a foot covering and holding open an opening of the foot covering, wherein said foot covering retaining member is three posts that are cylindrical in shape and extend from said surface of said base such that the axes of said posts are perpendicular to said surface of said base and are oriented at an angle to the floor;

wherein said base defines a foot receiving opening that extends through said base, and wherein said foot receiving opening is not completely surrounded by said base, and wherein said foot covering retaining member is located proximate to said foot receiving opening;

a second foot covering retaining member carried by said base, said second foot covering retaining member configured for receiving a foot covering and holding open an opening of the foot covering, wherein said second foot covering retaining member is three posts that are cylindrical in shape and extend from said surface of said base such that the axes of said posts are perpendicular to said surface of said base and are oriented at an angle to the floor;

wherein said base defines a second foot receiving opening that extends through said base, and wherein said second foot receiving opening is not completely surrounded by said base, and wherein said second foot covering retaining member is located proximate to said second foot receiving opening; and a foot receiving member having a surface sufficient for being contacted by substantially all of the bottom of a foot of the user, wherein said foot receiving member is carried by said base, and wherein said surface of said foot receiving member is oriented at an angle to the floor such that said surface is not parallel to the floor and wherein said surface of said foot receiving member is parallel to said surface of said base, wherein said foot receiving member extends from a location on said surface of said base located between said foot covering retaining member and said second foot covering retaining member.

* * * * *

UNITED STATES PATENT AND TRADEMARK OFFICE

CERTIFICATE OF CORRECTION

PATENT NO. : 7,634,862 B2
APPLICATION NO. : 11/599528
DATED : December 22, 2009
INVENTOR(S) : Cockman It is certified that error appears in the above-identified patent and that said Letters Patent is hereby corrected as shown below:

Title page, item [54] and col. 1, Title should read as "SOCK DONNING ASSIST DEVICE"

Signed and Sealed this

Sixteenth Day of February, 2010

David J. Kappos

David J. Kappos
*Director of the United States Patent and Trademark Office*